US007379036B2

(12) United States Patent
Arai et al.

(10) Patent No.: US 7,379,036 B2
(45) Date of Patent: May 27, 2008

(54) DRIVING CIRCUIT FOR VACUUM FLUORESCENT DISPLAY

(75) Inventors: Hiroyuki Arai, Gunma (JP); Syuji Motegi, Tochigi (JP); Takeshi Kimura, Tochigi (JP); Tetsuya Tokunaga, Gunma (JP)

(73) Assignee: Sanyo Electric Co., Ltd., Osaka (JP)

( * ) Notice: Subject to any disclaimer, the term of this patent is extended or adjusted under 35 U.S.C. 154(b) by 673 days.

(21) Appl. No.: 10/808,589

(22) Filed: Mar. 25, 2004

(65) Prior Publication Data

US 2004/0212570 A1 Oct. 28, 2004

(30) Foreign Application Priority Data

Mar. 26, 2003 (JP) ..... 2003-086465
Mar. 26, 2003 (JP) ..... 2003-086466

(51) Int. Cl.
*G09G 3/22* (2006.01)

(52) U.S. Cl. ..... 345/75.1; 315/169.1; 315/169.2; 315/169.3

(58) Field of Classification Search ..... 345/34, 345/47, 96, 618, 75.1; 246/1 C; 340/815.44; 714/811; 445/24; 315/169.1–169.3, 307
See application file for complete search history.

(56) References Cited

U.S. PATENT DOCUMENTS 4,297,692 A * 10/1981 Maier ..... 345/618
4,511,894 A * 4/1985 Johnston ..... 345/34
5,155,413 A * 10/1992 Bozzer et al. ..... 315/169.1
5,453,668 A * 9/1995 Chow ..... 315/307
5,515,390 A * 5/1996 Benton ..... 714/811
5,563,622 A * 10/1996 Person et al. ..... 345/75.1
5,805,134 A * 9/1998 Seki et al. ..... 246/1 C
6,005,538 A * 12/1999 Hoekstra ..... 345/47
6,097,302 A * 8/2000 Zinzell ..... 340/815.44
6,424,330 B1 * 7/2002 Johnson ..... 345/96
6,926,573 B2 * 8/2005 Moon ..... 445/24

FOREIGN PATENT DOCUMENTS

DE 32 06 123 9/1983
JP 10 268823 10/1998
JP 2002108263 4/2002

OTHER PUBLICATIONS

European Examination Report dated Aug. 14, 2006, issued in connection with European Patent Application No. 04 251 789.6-2205 (6 pages).
Display Technologies Series: Vacuum Fluorescent Displays 8.2 The Basic Driving Circuits (pp. 154-158), Sangyo Tosho, incl. English-language translation.

* cited by examiner

*Primary Examiner*—Amare Mengistu
*Assistant Examiner*—Yuk Chow
(74) *Attorney, Agent, or Firm*—Fish & Richardson P.C.

(57) ABSTRACT

A driving circuit for a vacuum fluorescent display for pulse-driving a filament of the vacuum fluorescent display with a pulse voltage. The driving circuit comprises a detecting unit for detecting that the level of the pulse voltage is fixed, and outputs a detection signal indicative of the result of the detection. Preferably, the driving circuit comprises a control unit for controlling at least one output of the outputs of the filament driving unit, the grid driving unit and the segment driving unit in order to terminate the driving of at least one of the filament, the grid electrode and the segment electrode, based on the detection signal.

20 Claims, 9 Drawing Sheets

--PRIOR ART--

DRIVING CIRCUIT FOR VACUUM FLUORESCENT DISPLAY

CROSS-REFERENCE TO RELATED APPLICATIONS

This application claims the benefit of priority to Japanese Patent Application Nos. 2003-86466 and 2003-86465 both filed Mar. 26, 2003, contents thereof being incorporated herein by reference.

BACKGROUND OF THE INVENTION

1. Field of the Invention

The present invention relates to a driving circuit for a vacuum fluorescent display.

2. Description of the Related Art

A vacuum fluorescent display (hereinafter, referred to as "VFD") is a display device of a self-illuminating type for displaying a desired pattern by causing a direct-heating type cathode called a filament to emit thermoelectrons by causing it to generate heat by applying a voltage thereto in a vacuum chamber and by causing the thermoelectrons to collide against fluorescent material on an anode (segment) electrode and causing them to illuminate, by accelerating the thermoelectrons using a grid electrode. VFDs have excellent features in terms of visibility, multi-coloring, low operating voltage, reliability (environmental resistance) etc. and are used in various applications and fields such as cars, home appliances and consumer products.

Here, for a VFD, in the case where a short circuit or wire-breaking has occurred to the filament or its wiring, where a short circuit has occurred between the wiring of the filament and the wiring of another electrode(such as the anode electrode or the grid electrode) or where an element for driving the filament has had a failure, there arises risk of causing damage to the filament or ignition of the filament when the abnormal state of the filament is left as it is. Therefore, a mechanism for detecting immediately such an abnormal state of the filament is sought for the VFD.

FIG. 9 illustrates a conventional mechanism for detecting an abnormal state of a filament voltage applied to a filament 11 as one of the mechanisms as described above. The figure shows an example in which, as a scheme for applying a voltage to the filament 11, "pulse-driving scheme" in which a pulse voltage (hereinafter, referred to as "filament pulse voltages") produced by chopping a considerably higher DC voltage compared to the ordinary nominal voltage of the filament is applied is employed. That is, in the pulse-driving scheme, the progress of the damage to or the ignition of the filament 11 is faster compared to that in other schemes (such as DC-driving scheme and AC-driving scheme) in case an abnormal state such as that the filament pulse voltage is fixed to the higher potential side has occurred. Therefore, it is important to detect immediately the abnormal state of the filament pulse voltage.

In FIG. 9, an external controller 40 such as a microcomputer outputs a pulse-driving signal with a duty ratio set at a desired ratio to a filament driving circuit 110. Then, the filament driving circuit 110 generates a filament pulse voltage from a power source for the filament 11 by a switching operation based on the pulse-driving signal received from the external controller 40, and applies the filament pulse voltage to the filament 11.

Here, the external controller 40 comprises a detecting unit for detecting, for example, the pulse width or the voltage level of the filament pulse voltage for the filament pulse voltage applied to the filament 11.

The external controller 40 executes feed back control in which the settings of the duty ratio of the pulse-driving signal that the external controller 40 outputs to the filament driving circuit 110 are adjusted in response to the pulse width or the voltage level of the filament pulse voltage detected by the detecting unit.

The mechanism described above is disclosed in, for example, Japanese Patent Application Laid-Open Publication No. 2002-108263.

In the conventional mechanism for detecting an abnormal state of the filament pulse voltage, the external controller 40 detects the pulse width or the voltage level of the filament pulse voltage and desired feedback control is executed to the filament pulse voltage in response to the detected values. However, this is also a factor for increasing the load of processing on the external controller 40. Furthermore, the external controller 40 has a problem that it needs considerable time from the moment at which it detects an abnormal state of the filament pulse voltage to the moment at which it executes a predetermined response (for example, turning off the power of the filament driving circuit 110), due to the increase of the load of processing in itself and, therefore, leads to the damage or the ignition of the filament 11.

SUMMARY OF THE INVENTION

In order to solve the above problems, a major aspect of the present invention provides a driving circuit for a vacuum fluorescent display for pulse-driving a filament of the vacuum fluorescent display with a pulse voltage, comprising a detecting unit for detecting that the level of the pulse voltage is fixed, the detecting unit outputting a detection signal indicative of the result of the detection. Preferably, the driving circuit for a vacuum fluorescent display comprises a grid driving unit for driving a grid electrode of the vacuum fluorescent display and a segment driving unit for driving a segment electrode of the vacuum fluorescent display. The driving circuit may further comprise a control unit for controlling at least one output of the outputs of the filament driving unit, the grid driving unit and the segment driving unit in order to terminate the driving of at least one of the filament, the grid electrode and the segment electrode, based on the detection signal.

According to the invention, it is possible to provide a driving circuit for a vacuum fluorescent display that improves the reliability of the vacuum fluorescent display.

The other features of the present invention will become clear from the descriptions of this specification and the accompanying drawings.

BRIEF DESCRIPTION OF THE DRAWINGS

The above and other features, aspects and advantages of the invention will be understood more clearly with reference to the following description, appended claims and the attached drawings in which;

DETAILED DESCRIPTION OF THE INVENTION

Embodiments of the invention will now be described in detail referring to the accompanying drawings.

<System Composition>

Figure 1:
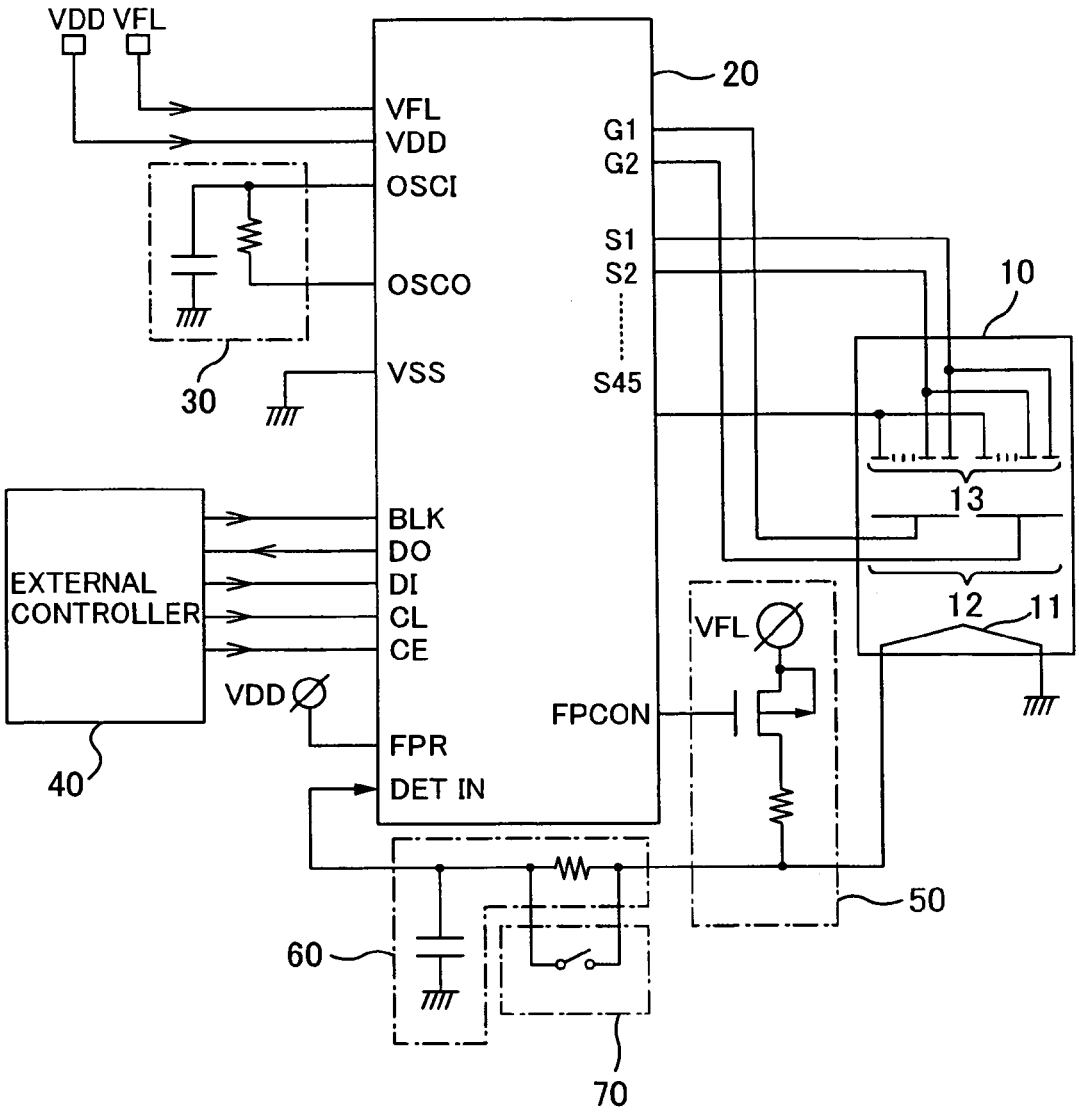
FIG. 1 shows a schematic composition of a system including a driving circuit for a vacuum fluorescent display according to an embodiment of the invention.

FIG. 1 shows a schematic composition of a system including a driving circuit for a vacuum fluorescent display 20 according to an embodiment of the invention. In the VFD driving circuit 20 shown in the figure, "pulse-driving scheme" is employed as the scheme for applying a voltage to the filament 11. The pulse-driving scheme" is a scheme in which a pulse voltage (hereinafter, referred to as "filament pulse voltage") produced by chopping a considerably higher DC voltage compared to the ordinary nominal voltage of the filament 11 is applied to the filament 11.

The VFD driving circuit 20 employs "dynamic driving scheme" driving a grid electrode 12 and a segment electrode 13 and the number of display digits by the grid electrode 12 is set at two (2) (this form of the grid electrode 12 is referred to as "½ duty"). The segment number is set at "90". The VFD driving circuit 20 according to an embodiment of the invention is not limited to those with the above-described number of grids (two-column) and the number of segments (90 segments), and the grid electrode 12 and the segment electrode 13 may be driven in a driving scheme in which either of the dynamic driving scheme or static driving scheme is combined. For example, in the case where the static driving scheme is employed, all of the column display is executed by the segment electrodes 13 of the number same as the number of the segments and one grid electrode 12. In this case, a constant voltage (grid voltage) is applied to the one grid electrode 12.

The overview of the dynamic driving scheme and the static driving scheme described above are described in, for example, "Display Technologies Series: Vacuum Fluorescent Displays 8. 2 The Basic Driving Circuits (pp. 154-158)", Sangyo Tosho.

As to the peripheral circuitry of the VFD driving circuit 20, a VFD 10, an external oscillator 30, the external controller 40, a switching element 50, a low-pass filter 60 and a switch unit 70 will be described one by one.

The VFD 10 comprises the filament 11, the grid electrode 12 and the segment (anode) electrode 13. The filament 11 is heated by application of a filament pulse voltage based on the pulse driving scheme through the switching element 50, and emits thermoelectrons. The grid electrode 12 acts as an electrode for selecting columns and accelerates or blocks the thermoelectrons emitted by the filament 11. The segment electrode 13 acts as an electrode for selecting a segment. However, fluorescent material is applied on the surface of the segment electrode 13 in a shape of the pattern to be displayed, and a desired pattern is displayed by causing the fluorescent material to illuminate by causing the thermoelectrons accelerated by the grid electrode 12 to collide against the fluorescent material.

Furthermore, in the VFD 10, a lead is drawn out independently for each column respectively from the grid electrode 12 while a lead for which segments corresponding to each column are internally connected with each other is drawn out from the segment electrode 13. These leads drawn from the grid electrode 12 and the segment electrode 13 are connected respectively with corresponding output terminals of the VPD driving circuit 20 (grid output terminals are G1-G2 and segment output terminals are S1-S45).

An external oscillator 30 is an RC oscillator comprising a resistor R, a capacitance element C etc. and constitutes an RC oscillation circuit by being connected with oscillator terminals (OSCI terminal, OSCO terminal) of the VFD driving circuit 20. The external oscillator 30 may by a quartz-crystal oscillator or ceramic vibrator each having a specific oscillation frequency and a crystal as a self-driving oscillation unit or a ceramic oscillation circuit may by composed. Furthermore, the external oscillator 30 may be an externally-driven oscillating unit providing a clock signal for externally-driven oscillation to the VFD driving circuit 20.

The external controller 40 is an apparatus such as a micro-computer not containing any VFD driving element, and is connected with the VFD driving circuit 20 through data bus for transferring serial data, and transmits signals necessary for driving the VFD 10 to the VFD driving circuit 20 in a predetermined data transfer format. The data transfer between the external controller 40 and the VFD driving circuit 20 is not limited to the serial data transfer described above and may be parallel data transfer.

The switching element 50 is a P-channel MOS-type FET and its gate terminal is connected with an FPCON terminal of the VFD driving circuit 20, outputting the pulse driving signal described later. The switching element 50 is not limited to the P-channel MOS-type FET and, for example, an N-channel MOS-type FET may be used and, in addition, a composition in which an N-channel MOS-type FET and a P-channel MOS-type FET are combined may be used. Furthermore, the switching element 50 generates the filament pulse voltage to be applied to the filament 11 of the VFD 10 from a filament power voltage VFL by executing ON/OFF operation in response to the pulse driving signal provided from an FPCON terminal of the VFD driving circuit 20.

An FPR terminal of the VFD driving circuit 20 shown in FIG. 1 is an input terminal for setting the polarity of the pulse driving signal outputted from an FPCON terminal in response to the input/output property of the switching element 50 and, for example, as shown in FIG. 1, in the case where a P-channel MOS-type FET is employed as the switching element 50, the FPR terminal is connected with a power voltage VDD ("H"-fixed). In addition, in the case where an N-channel MOS-type FET is employed as the switching element 50, the FPR terminal is connected with ground ("L"-fixed).

The low-pass filter 60 is an RC integrating circuit comprising a resistor R and a capacitance element C, and its input is connected with an output terminal for the filament pulse voltage of the switching element 50 and its output is connected with a DETIN terminal of the VFD driving circuit 20. As the resistance R and the capacitance element C constituting the low-pass filter 60, elements having nominal values large enough for integrating the filament pulse voltage and rectifying the resultant voltage into a DC voltage are used. That is, the low-pass filter 60 is a unit which, when the filament pulse voltage produced by the switching element 50 has been inputted into it, produces a voltage which has been rectified into a DC voltage by integrating the filament pulse voltage, and inputs the produced voltage into the DETIN terminal of the VFD driving circuit 20.

Furthermore, the low-pass filter 60 is an external circuit to the VFD driving circuit 20, necessary for a level detecting unit described later, and is not necessary for a pulse detecting unit also described later. Then, in the case where the pulse detecting unit described later is used, the low-pass filter 60 is removed and the filament pulse voltage produced by the switching element 50 may be arranged to be inputted into the DETIN terminal of the VFD driving circuit 20.

Otherwise, as shown in the FIG. 1, the system may be arranged to comprise the switch unit 70 connected in parallel to a resistor of the low-pass filter 60 (or the low-pass filter 60 itself) and, in the case where the pulse detecting unit described later is used, to operate the switch unit 70 such that the resistor of the low-pass filter 60 is short-circuited (or the low-pass filter itself is short-circuited). In this case, the control signal to operate the switch unit 70 may be arranged to be supplied directly from the external controller 40 to the switch unit 70 or from the external controller 40 to the switch unit 70 through the VFD driving circuit 20.

Figure 2:
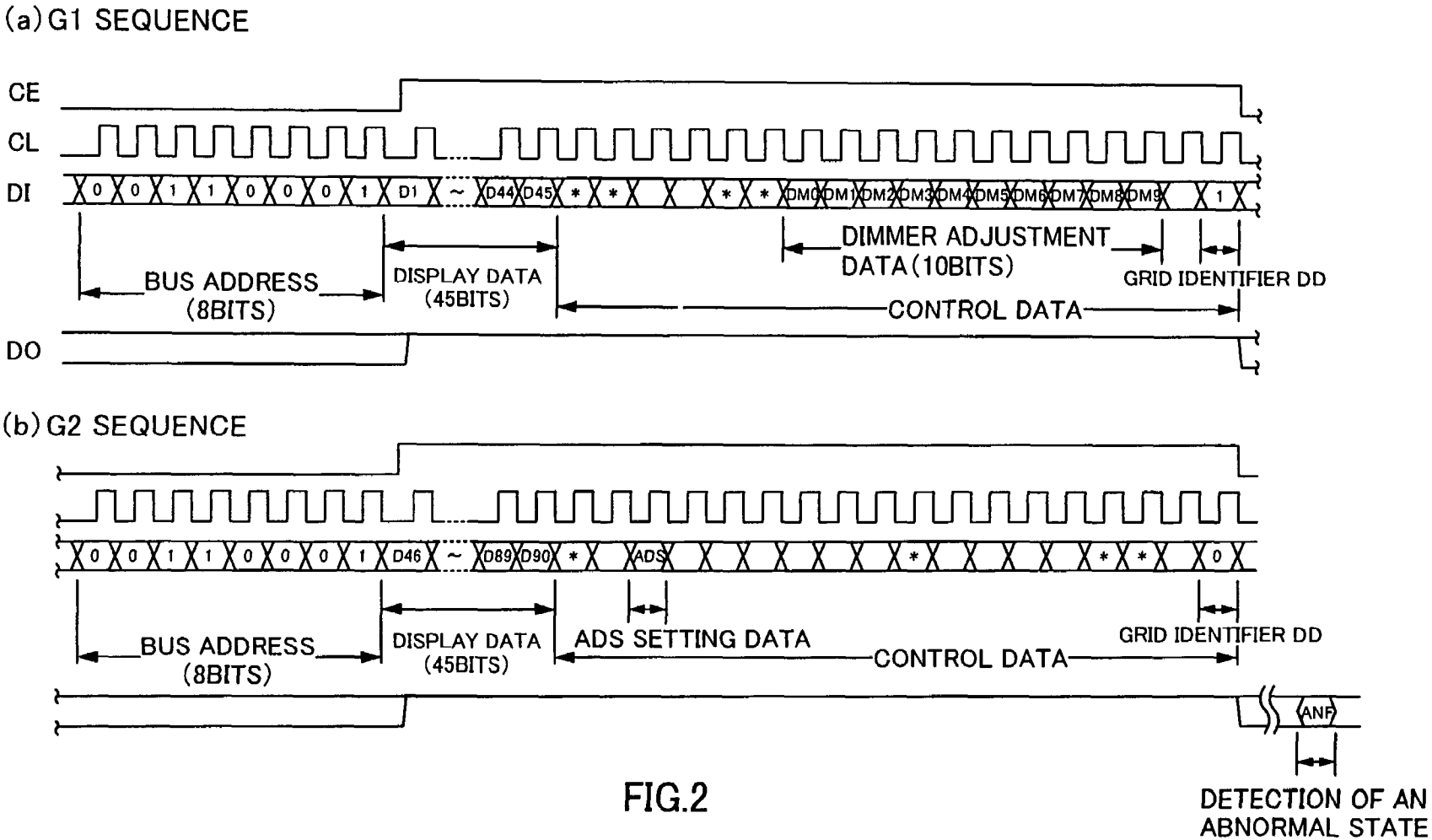
FIG. 2 shows a timing chart for the data transfer format used between an external controller and the driving circuit for a vacuum fluorescent display according to an embodiment of the invention.

FIG. 2 shows a timing chart for a data transfer format between the external controller 40 and the VFD driving circuit 20. As shown in the figure, the data transfer format has a sequence relating to a grid electrode GI (hereinafter, referred to as "G1 sequence") and a sequence relating to a grid electrode G2 (hereinafter, referred to as "G2 sequence"). The data transfer format is not limited to the format described above and both of the G1 sequence and the G2 sequence may be executed at one time.

The G1 sequence and the G2 sequence will be described schematically.

First, in the G1 sequence, the external controller 40 transmits to the VFD driving circuit 20 a bus address (8 bits) given to the VPD driving circuit 20 together with a synchronizing clock signal CL. The VFD driving circuit 20 identifies whether the received address is the bus address given to the circuit 20 itself or not. Then, when the circuit 20 identifies the bus address as the bus address given to the circuit 20 itself, the circuit 20 receives a control order (control data etc. described later) transmitted as attached to the received bus address from the external controller 40 as a control order to the circuit 20 itself. As described above, a bus address is a specific address given to each respective IC and is used for the external controller 40 to control a plurality of ICs on the same bus line in an embodiment where the external controller 40 and the plurality of ICs are connected on the same bus line.

Next, the external controller 40 makes the VFD driving circuit 20 be in an enable (selection) state by asserting (putting at the H level) a chip enable signal CE and, then, transmits 45-bit display data (D1-D45) for the grid electrode G1, 16-bit control data used for each control of the VFD driving circuit 20 etc. The 16-bit control data contains 10-bit dimmer adjustment data (DM0-DM9) as the data for adjusting the intensity of the VFD 10, and a grid identifier DD (for example, "1" for a grid electrode G1 and "0" for a grid electrode G2) etc.

Thereafter, the external controller 40 makes the VFD driving circuit 20 be in a disable (non-selection) state by negating (putting at an L level) the chip enable signal CE and, concurrently, terminates the transmission of the synchronizing clock signal CL, then, the G1 sequence is concluded.

On the other hand, in the G2 sequence, in a same procedure as that of the G1 sequence described above, 45-bit display data (D46-D90) relating to the grid electrode G2 are transmitted. In the G2 sequence, as the control data transmitted to the VFD driving circuit 20, ADS (Abnormal Detect type Select) setting data described later is held.

<VFD Driving Circuit>

Figure 3:
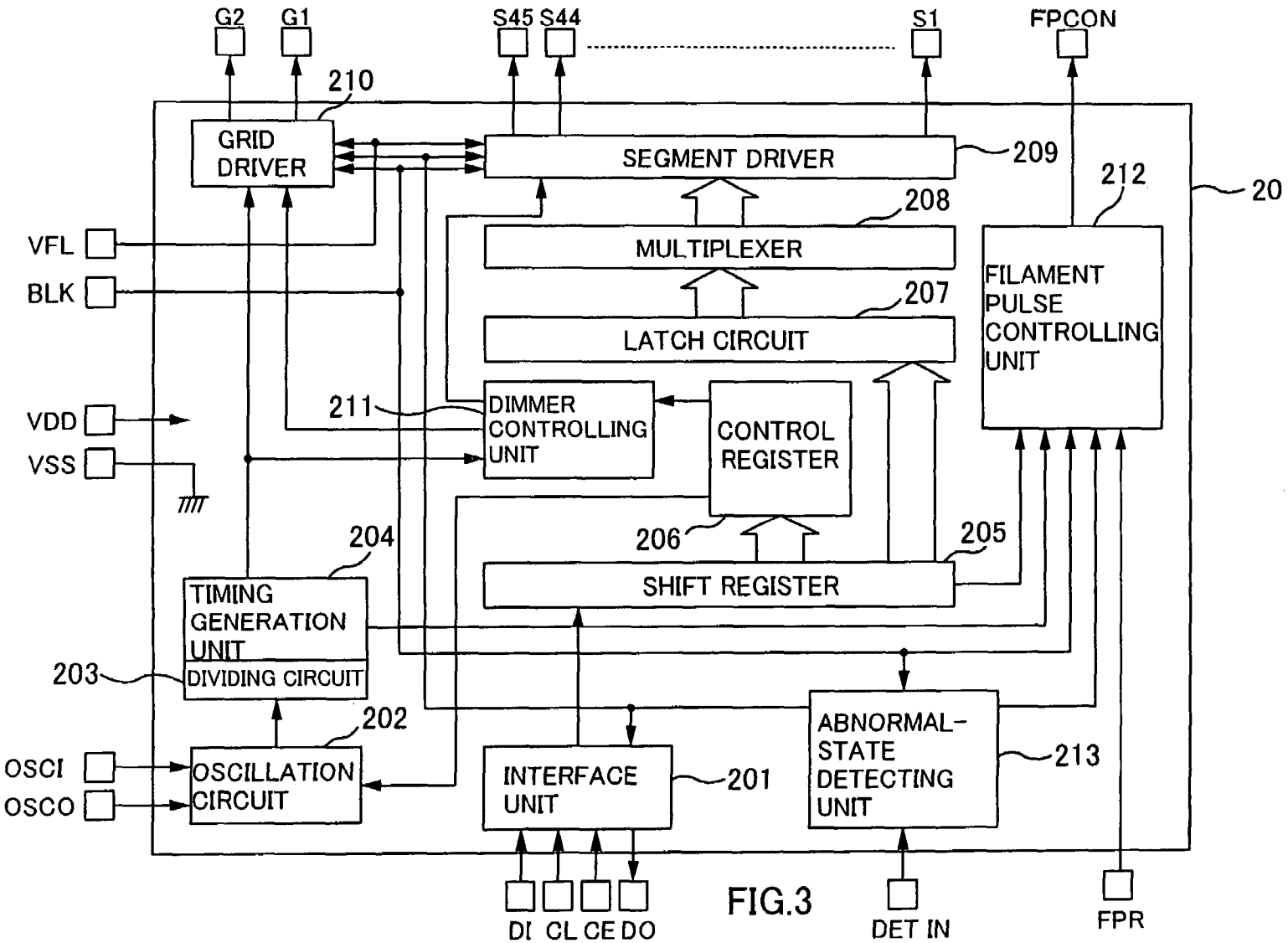
FIG. 3 shows a block diagram of the driving circuit for a vacuum fluorescent display according to an embodiment of the invention.

FIG. 3 shows a block diagram of the VFD driving circuit 20 of the pulse driving scheme according to an embodiment of the invention.

The VFD driving circuit 20 comprises an interface unit 201, an oscillation circuit 202, a dividing circuit 203, a timing generator 204, a shift register 205, a control register 206, a latch circuit 207, a multiplexer 208, a segment driver 209, a grid driver 210, a dimmer controlling unit 211, a filament pulse controlling unit 212 and an abnormal-state detection unit 213.

The interface unit 201 is an interface unit for transmitting/receiving of data as shown in FIG. 2 with the external controller 40.

The oscillation circuit 202 generates the reference clock signal for the VFD driving circuit 20 by connecting the external oscillator 30 with the terminals for oscillator (OSCI, OSCO). This reference clock signal is divided into a predetermined dividing number by the dividing circuit 203 and supplied to the timing generator 204. The frequency of the reference clock signal (oscillation clock) is set in the audible band or above such that no sound noise is generated at the filament 11 and, concurrently, is set under a predetermined upper limit frequency taking into account the influence of the power consumption of the VFD driving circuit and radio noises.

The timing generator 204 outputs a signal (hereinafter, referred to as "internal clock signal A") for determining the timing etc. of a signal (hereinafter, referred to as "grid driving signal") for driving the grid electrodes G1-G2 based on the signal supplied from the dividing circuit 203, and a signal (hereinafter, referred to as "internal clock signal B") for determining the timing of a pulse driving signal described later in the filament pulse controlling unit 212, etc.

The shift-register 205 converts 45-bit display data (D1-D45 or D46-D90) and 16-bit control data (the dimmer adjustment data (DM0-DM9) etc.) received by the interface unit 201 for respectively each of the G1 and G2 sequence described above, into pulse data, and supplies the pulse data to the control register 206, the latch circuit 207, a filament pulse controlling unit 212 etc.

The control register 206 stores the 32-bit (16 bits×2) control data supplied from the shift register 205. The dimmer adjustment data (DM0-DM9) contained in the control data are supplied to a dimmer control unit 211.

The latch circuit 207 holds the 45-bit display data (D1-D45) relating to the grid electrode G1 and the 45-bit display data (D46-D90) relating to the grid electrode G2 supplied from the shift register 205. That is, the latch circuit 207 holds 90-bit display data (D1-D90) for each of the repetition cycles relating to driving of the grid electrodes G1 and G2.

A multiplexer 208 selects the 45-bit display data relating to the grid electrode G1 or G2 which is to be driven among the 90-bit display data (D1-D90) held by the latch circuit 207 and supplies them to a segment driver 209, at the timing for driving each of the grid electrodes G1 and G2.

The segment driver 209 forms a signal for driving segment electrodes S1-S45 based on the 45-bit display data selected and supplied by the multiplexer 208, and outputs it to the segment electrodes S1-S45. The signal for driving the segment electrodes S1-S45 may be voltages to be applied to the segment electrodes S1-S45 (hereinafter, referred to as "segment voltage") or a control signal to be supplied to a driving element intervened between the segment driver 209 and the segment electrodes S1-S45 (hereinafter, the segment voltage and the control signal are collectively referred to as "segment driving signal").

The grid driver 210 forms a grid driving signal based on the internal clock signal A supplied from the timing generator 204, and outputs it to the grid electrodes G1-G2. The signal for driving the grid electrodes G1-G2 may be voltages to be applied to the grid electrodes G1-G2 (hereinafter, referred to as "grid electrode") or a control signal to be supplied to a driving element intervened between the grid driver 210 and the grid electrodes G1-G2 (hereinafter, the grid voltage and the control signal are collectively referred to as "grid driving signal").

The dimmer controlling unit 211 makes the duty ratios of the grid driving signal and the segment driving signal be adjustable based on the dimmer adjustment data (DM0-DM9) supplied from the control register 206.

The filament pulse controlling unit 212 forms the pulse driving signal for pulse-driving the filament 11 based on the internal clock signal B supplied from the timing generator 204 and outputs it to the switching element 50. The filament pulse controlling unit 212 sets the polarity of the pulse driving signal based on a signal supplied from the FPR terminal.

The abnormal-state detection unit 213 detects that the level of the filament pulse voltage is fixed and outputs an abnormal-state detection signal indicating the detection result. The level of this abnormal-state detection signal is set at "1" when the filament pulse voltage is as usual and is set at "0" when it is detected that the level of the filament pulse voltage is fixed.

The VFD driving circuit 20 has a BLK terminal for making the VFD display available for being turned on, or for being turned off. The BLK terminal is connected such that it is supplied with data from the external controller 40. For example, it is possible for each control unit to respectively operate such that the above-described grid driving signal and the segment driving signal are fixed at the L level and the pulse driving signal is fixed at the H level, when "1" is supplied from the external controller 40 to the BLK terminal, and to turn off the VFD display.

FIRST EMBODIMENT

==Abnormal-State Detecting Unit==

Figure 4:
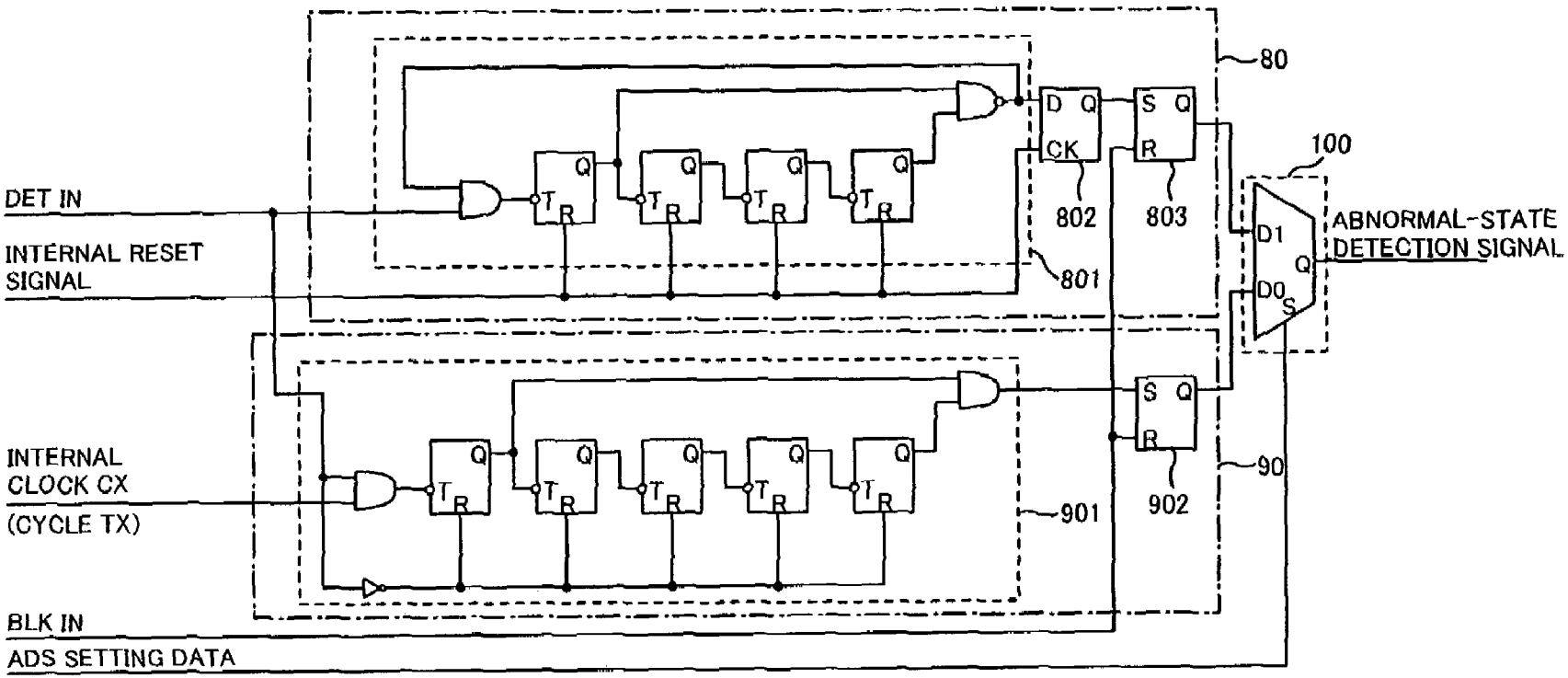
FIG. 4 shows a circuit composition diagram of an abnormal-state detecting unit according to an embodiment of the invention.

Referring to FIG. 4, the composition of the circuit of the abnormal-state detecting unit 213 according to a first embodiment of the invention will be described.

The abnormal-state detecting unit 213 has the pulse detecting unit 80, the level detecting unit 90 and a selecting unit 100 as shown in the figure.

The pulse detecting unit 80 detects that the level of the filament pulse voltage is fixed based on the number of pulses per predetermined period TP of the filament pulse voltage inputted from the DETIN terminal.

The level detecting unit 90 detects that the level of the filament pulse voltage is fixed based on the level of the DC-rectified voltage produced by integrating the filament pulse voltage inputted from the DETIN terminal.

The level of the DC-rectified voltage is set within a low range for which the duty ratio of the filament pulse voltage is in some "5-20%" because the amount of power supplied to the filament 11 is limited. Therefore, the level is set to be lower than the maximum VILmax of the input voltage recognized as the L level in an IC (Integrated Circuit) in the VFD driving circuit 20. That is, when the filament pulse voltage is in a normal state, the level of the DC-rectified voltage is recognized as the L level in the IC in the VFD driving circuit 20.

The level of the DC-rectified voltage is higher than the minimum VIHmin of the input voltage that is recognized as the H level in the IC in the VFD driving circuit 20 when an abnormal state in which the filament pulse voltage is fixed at the H level has been occurred, and is, therefore, recognized to be at the H level.

In this manner, the level detecting unit 90 can detect that the filament pulse voltage is fixed based on the level of the DC-rectified voltage.

The selecting unit 100, for example, selects the output of the level detecting unit 90 when ADS (Abnormal Detect type Select) setting data indicates "0" and selects the output of the pulse detecting unit 80 when it indicates "1" based on the ADS setting data contained in the control data of the above-described G2 sequence received from the external controller 40. Furthermore, the selecting unit 100 outputs the output of the selected one of the level detecting unit 90 and the pulse detecting unit 80, as an abnormal-state detection signal. The abnormal-state detection signal is outputted from a DO terminal to the external controller 40 as an abnormal-state detecting flag ANF (for example, "1" for a normal state and "0" for an abnormal state).

In this manner, the VFD driving circuit 20 can reduce the load of processing of the external controller 40 such as a microcomputer. Furthermore, it is possible to detect immediately that the level of the filament pulse voltage is fixed, that is, an abnormal state of the filament pulse voltage. Therefore, it is possible to improve the reliability of the VFD 10 (especially, the reliability for the filament 11 of the VRD 10).

==Pulse Detecting Unit==

Referring to FIG. 4, the circuit composition of the pulse detecting unit 80 according to an embodiment of the invention will be described.

The pulse detecting unit 80 comprises a first counting unit 801, a D-flip-flop 802 and an RS-flip-flop 803.

The first counting unit 801 counts the pulses per predetermined period TP of the filament voltage inputted from the DETIN terminal and outputs one of the levels (for example, "1") indicating that the level of the filament pulse voltage is fixed when the number of pulses that it has counted equals the reference number of the pulses PN or is lower. Furthermore, it outputs the other level (for example, "0") indicating that the level of the filament voltage is in a normal state when the number that is has counted exceeds the reference number of the pulses PN.

The first counting unit 801 resets the counted number at the timing at which a signal to specify the end of the predetermined period TP (hereinafter, referred to as "internal resetting signal (FIG. 5(B))")rises. Here, the predetermined period TP is a period in which, for example, each of the grid electrodes G1 and G2 is respectively driven. The reference number of pulses PN is set at around nine (9) pulses assuming the case where noise is counted.

D-flip-flop 802 latches the output of the first counting unit 801 using the internal resetting signal, and outputs it to the RS-flip-flop 803 in the next stage.

The RS-flip-flop 803.is a unit for holding the output of the D-flip-flop 802. The RS-flip-flop 803 sets the abnormal-state detection signal when "1" is inputted into its S terminal as the output of the D-flip-flop 802. The state in which this abnormal-state detection signal is set is held until a BLKIN signal (a signal inputted from a BLK terminal) is inputted into an R terminal. That is, the external controller 40 recognizes an abnormal state of the filament pulse voltage and, as a form of a countermeasure against the abnormal state, the abnormal-state detection signal is reset when "1" is inputted into the BLK terminal to turn off the display of the VFD 10.

Figure 5:
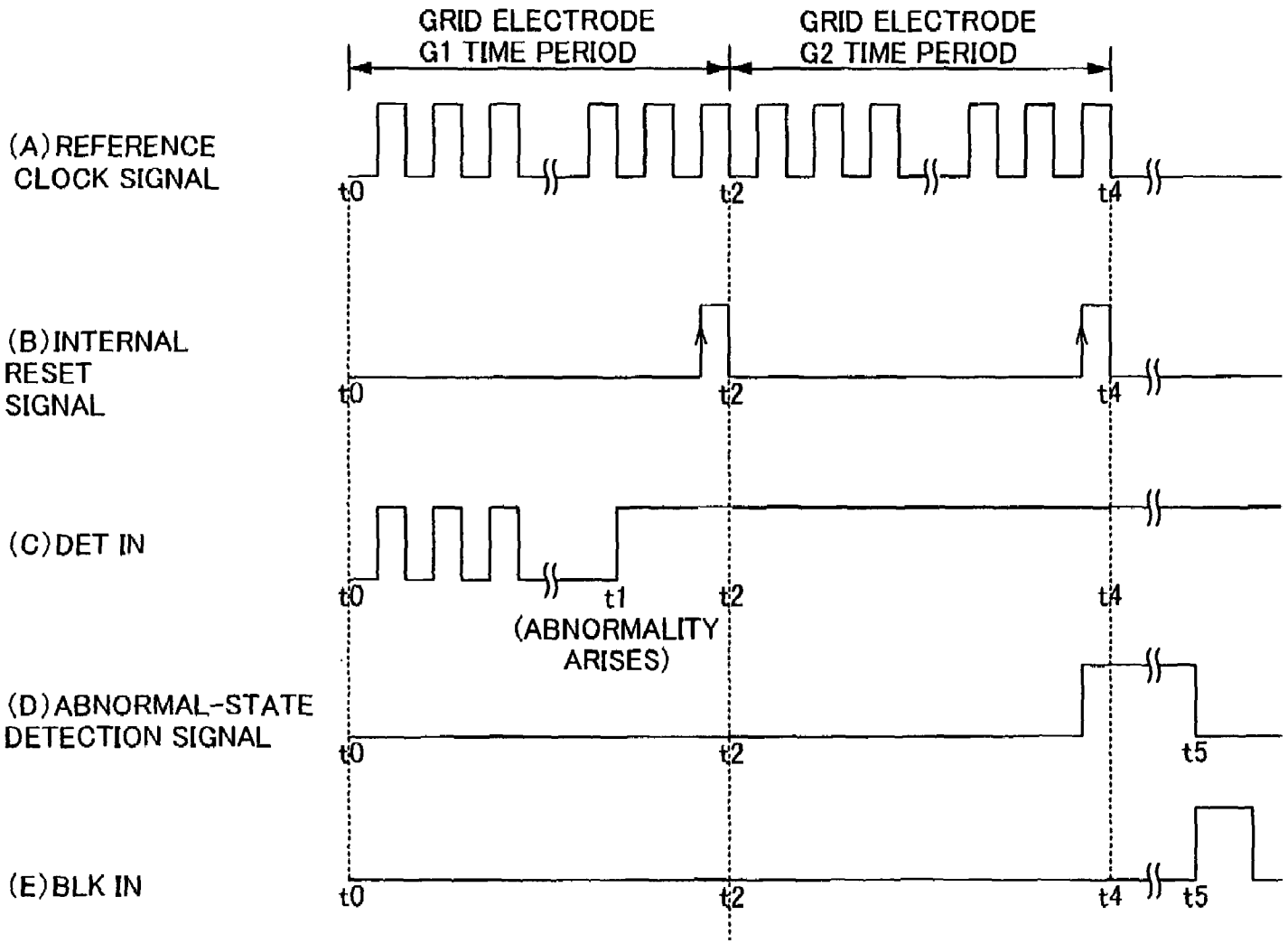
FIG. 5 shows a timing chart for illustrating the operation of a pulse detecting unit according to an embodiment of the invention.

FIG. 5 is a timing chart for illustrating the operation of the pulse detecting unit 80. The figure shows the case where the level of the filament pulse voltage (FIG. 5(C)) inputted from the DETIN terminal at time t1 in a time period for driving the grid electrode G1 (hereinafter, referred to as "grid electrode G1 time period") is assumed to be fixed at the H level. During the time period from the time t0 to the time t1, the number of the pulses of the filament pulse voltage (FIG. 5(C)) counted by the first counting unit 801 is assumed to equal or exceed the reference number of the pulses PN (nine (9) pulses).

First, in the grid electrode G1 time period, as described above, at the time t1, an abnormal state when the level of the filament pulse voltage (FIG. 5(C)) is fixed at the H level occurs. However, in the time period from the time t0 to the time t1, the number of the pulses of the filament pulse voltage (FIG. 5(C)) counted by the first counting unit 801 equals or exceeds the reference number of pulses PN (nine (9) pulses). Therefore, the output of the first counting unit 801 has been switched from the initial state of "1" to "0" at the time at which the internal resetting signal (FIG. 5(B)) rises for specifying the end of the grid electrode G1 time period. Thus, in the D-flip-flop 802 and the RS-flip-flop 803, "0" is latched by the rise (FIG. 5(B)) of the internal resetting signal and, as a result, the abnormal-state detection signal (FIG. 5(D)) is not reset.

Next, at the starting time t2 of a time period for driving the grid electrode G2 (hereinafter, referred to as "grid electrode G2 time period"), the number counted by the first counting unit 801 in the grid electrode G1 time period is reset and, concurrently, the number of pulses of the filament pulse voltage (FIG. 5(C)) is again counted. Here, the number counted by the first counting unit 801 until the time at which the internal reset signal (FIG. 5(B)) rises to specify the end of the grid electrode G2 time period is "0" pulse according to FIG. 5 (that is equal to or less than the reference number of pulses PN). Therefore, the output of the first counting unit 801 remains to be "1". Thus, "1" is latched in the D-flip-flop 802 and the RS-flip-flop 803 by the rise of the internal resetting signal (FIG. 5(B)) and, as a result, the abnormal-state detection signal (FIG. 5(D)) is set.

The abnormal-state detection signal (FIG. 5(D)) is outputted to the external controller 40 from a DO terminal as an abnormal-state detecting flag ANF. Then, the case is assumed where, at the time t5, the external controller 40 having read the abnormal-state detecting flag ANF outputs "1" to the BLK terminal based on its determination that the display of the VFD 10 should be turned off and initialized. In this case, the abnormal-state detection signal (FIG. 5(D)) is reset. The process after the abnormal-state detecting flag ANF has been read and an abnormal state is detected is that the display of the VFD 10 may be initialized and turned on again as described above, or the powers of the VFD driving circuit 20 and the switching element 50 may be turned off without doing anything before turning them off. The decision on this process is left to the external controller 40.

As described above, even when the filament pulse voltage is fixed at either H level or L level, the VFD driving circuit 20 can detect this situation by the pulse detecting unit 80. Furthermore, since the pulse detecting unit 80 does not need the low-pass filter 60 compared to the level detecting unit 90, the unit 80 has a merit that the number of parts therein may be reduced.

==Level Detecting Unit==

Referring to FIG. 4, the circuit composition of the level detecting unit 90 according to an embodiment of the invention will be described.

The level detecting unit 90 comprises a second counting unit 901 and an RS-flip-flop 902.

The second counting unit 901 starts its counting operation when the level of the DC-rectified voltage produced by integrating the filament pulse voltage inputted from the DETIN terminal is at a level (for example, the H level) indicating that the filament pulse voltage is fixed.

In addition, the second counting unit 901 counts the time period in which the level of the DC-rectified voltage is at a level (for example, the B level) indicating that the filament pulse voltage is fixed, based on an internal clock signal CX having a predetermined cycle TX. Then, the second counting unit 901 outputs one level (for example, "1") indicating that the filament pulse voltage is in an abnormal state when the time period obtained by multiplying the counted number by the cycle TX of the internal clock signal CX equals or exceeds a predetermined time period TL (for example, "408/3072=0.133" times as long as the time period for which each of the grid electrode G1 and G2 respectively is driven).

On the other hand, when the time period obtained by multiplying the counted number by the cycle TX is less than the predetermined time period TL, the second counting unit 901 outputs the other level (for example, "0") indicating that the filament pulse voltage is in a normal state. The counted number is reset when the level of the DC-rectified voltage is at a level (for example, the L level) indicating that the filament pulse voltage is in the normal state.

The RS-flip-flop 902 is a unit for holding the output of the second counting unit 901. Similarly to the above described RS-flip-flop 803 of the pulse detecting unit 80, the RS-flip-flop 902 sets an abnormal-state detection signal when "1" is inputted into its S terminal as the output of the second counting unit 901. The state in which this abnormal detection signal is set is held until the BLKIN signal is inputted into its R terminal.

Figure 6:
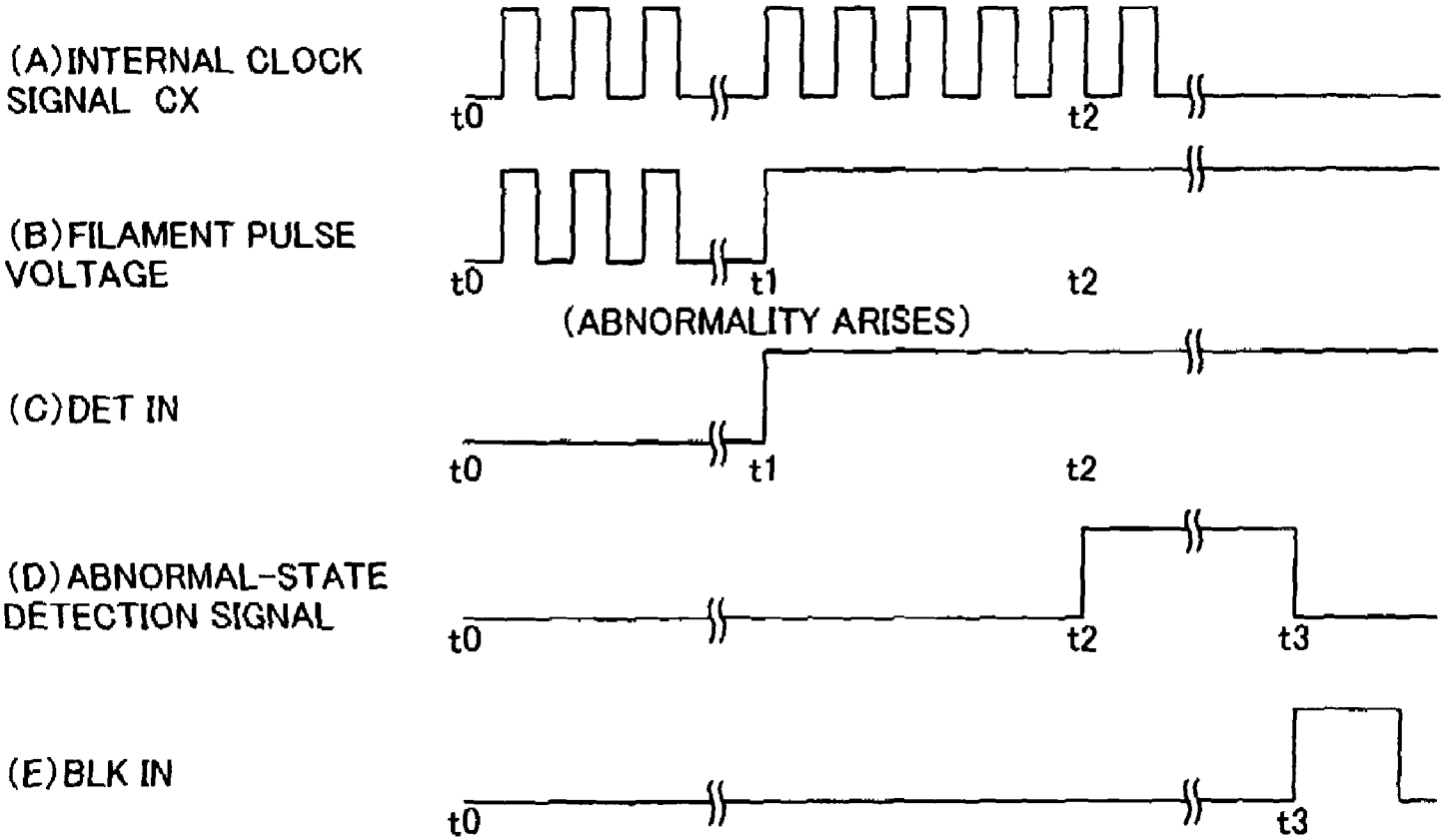
FIG. 6 shows a timing chart for illustrating the operation of a level detecting unit according to an embodiment of the invention.

FIG. 6 shows a timing chart for illustrating the operation of the level detecting unit 90. Here, a case where the filament pulse voltage (FIG. 6(B)) inputted from the DETIN terminal at the time t1 is fixed at the H level is assumed.

First, for a time period from the time to to the time t1, the level of the DC-rectified voltage (FIG. 6(C)) is at the L level indicating that the filament pulse voltage (FIG. 6(B)) is in the normal state. Therefore, the second counting unit 901 does not start its counting operation. Therefore, the RS-flip-flop 902 also does not operate and the abnormal-state detection signal (FIG. 6(D)) is not set.

Next, at the time t1, the level of the filament pulse voltage (FIG. 6(B) ) is fixed at the H level and, concurrently, the level of the DC-rectified voltage is fixed at the H level indicating that the filament pulse voltage (FIG. 6(B)) is in an abnormal state. Here, the second counting unit 901 starts its counting operation for counting the time period for which the level of the DC-rectified voltage (FIG. 6(C)) is at H level, based on the internal clock signal CX having the predetermined cycle TX.

Next, at the time t2, since the number having been counted since the time t1 by the second counting unit 901 equals or exceeds the reference counting number ("17" for the circuit example shown in FIG. 4) corresponding to the predetermined time period TL, the second counting unit 901 outputs "1" indicating that the filament pulse voltage is in an abnormal state. This output of the second counting unit 901 is inputted into the S terminal of the RS-flip-flop 902 and, as a result, the abnormal-state detection signal (FIG. 6(D)) is set.

The abnormal-state detection signal (FIG. 6(D)) is outputted from the DO terminal to the external controller 40 as the abnormal-state detecting flag ANF. Then, the case is assumed where, at the time t3, the external controller 40 having read the abnormal-state detecting flag ANF outputs "1" to the BLK terminal based on its determination that the display of the VFD 10 should be turned off and initialized. In this case, the abnormal-state detection signal (FIG. 6(D)) is reset. The process after the abnormal-state detecting flag ANF has been read and an abnormal state is detected is that the display of the VFD 10 may by initialized and turned on again as described above, or the powers of the VFD driving circuit 20 and the switching element 50 may be turned off without doing anything before turning them off. The decision on this process is completely left to the external controller 40.

As described above, the VFD driving circuit 20 can detect that the level of the filament pulse voltage is fixed by having the pulse detecting unit 80. Furthermore, it can also detect that the filament pulse voltage has an ordinary duty ratio of "5-20%".

In the embodiment described above, the VFD driving circuit 20 may set the abnormal-state detection signal when, in the pulse detecting unit 80, the number of pulses of the filament pulse voltage per predetermined time period TP is equal to or exceeds the defined pulse number (for example, the predetermined time period TP/the cycle of the reference clock signal).

For example, the case is assumed, where the number of pulses of the filament pulse voltage per predetermined time period TP is equal to or exceeds the defined pulse number because of the case where pulse-like noises being out of phase are multiplexed on the filament pulse voltage. Then, the VFD driving circuit 20 according to this embodiment of the invention can determine and detect that the filament pulse voltage is fixed when the number of pulses of the filament pulse voltage per predetermined time period TP is equal to or exceeds the defined pulse number.

Furthermore, in the embodiment described above, the VFD driving circuit 20 may comprise only either one of the pulse detecting unit 80 or the level detecting unit 90. Otherwise, the circuit 20 may operate the pulse detecting unit 80 and the level detecting unit 90 in turns employing a time-division system.

Yet furthermore, in the embodiment described above, the switching element 50 may be provided to various application circuits using the VFD driving circuit 20 (for example, a vacuum fluorescent display module). Preferably, the VFD driving circuit 20 may be a semiconductor integrated circuit and the switching element 50 may be connectable externally. Otherwise, the circuit 20 may be a semiconductor integrated circuit embedded with the switching elements 50 that are integrated.

In the embodiment described above, when operating the level detection unit 90, the low-pass filter 60 may be provided in various application circuits (for example, a vacuum fluorescent display module) using the VFD driving circuit 20. Preferably, the VFD driving circuit 20 may be a semiconductor integrated circuit and the low-pass filter 60 may be connectable externally. Otherwise, the circuit 20 may be a semiconductor integrated circuit embedded with the low-pass filters 60 that are integrated.

SECOND EMBODIMENT

The VFD driving circuit 20 according to a second embodiment of the invention controls the output(s) of at least one of the segment driver 209, a grid driver 210 and the filament pulse controlling unit 212 to terminate driving of at least one of the segment electrode 13, the grid electrode 12 and filament 11 based on the output of the abnormal-state detecting unit 213 (abnormal-state detection signal).

The operation of the segment driver 209, the grid driver 210 and the filament pulse controlling unit 212 to be controlled as described above will be respectively described.

===Control of the Output of the Grid Driver or the Segment Driver===

Figure 7:
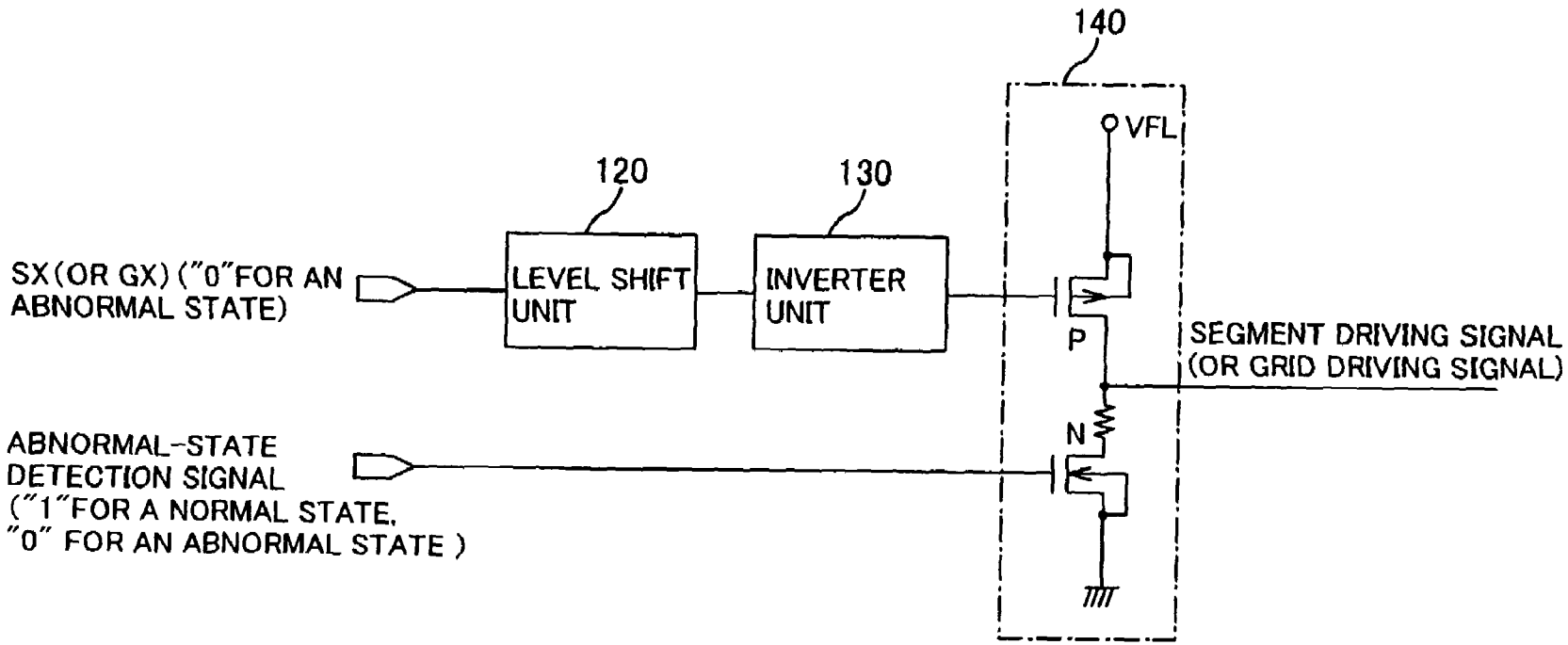
FIG. 7 shows a block diagram of a grid driver or a segment driver according to an embodiment of the invention.

Referring to FIG. 7, the operation of the segment driver 209 or the grid driver 210 based on the abnormal-state detection signal (the output of the abnormal-state detecting unit 213) will be described. In the following, description of the grid driver 210 executing the same operation as that of the segment driver 209 is omitted.

As shown in the figure, the segment driver 209 has a level shift unit 120, an inverter unit 130 and a driving signal output unit 140. In addition to the components described above, the segment driver 209 has a unit (not shown) for producing a signal SX for driving the segment electrode 13 based on the display data (D1-D90) selected and supplied by the multiplexer 208. The producing unit described above sets the level of the signal SX at "0" when the level of the abnormal-state detection signal as the output of the abnormal-state detecting unit 213 is "0", i.e., the level of the filament pulse voltage is fixed.

The level shift unit 120 outputs to the inverter unit 130 a signal produced by shifting the level of the signal SX from the level of the power voltage VDD for internal operation of the VFD driving circuit 20 to a level corresponding to the power voltage VFL for driving the filament 11.

The inverter unit 130 inverts the polarity of the signal SX inputted from the level shifter unit 120 and outputs the inverted signal to the driving signal output unit 140.

The driving signal output unit 140 has a composition in which a resistive element is connected between a P-channel MOS-type FET and an N-channel MOS-type FET and outputs the segment driving signal from a terminal of the resistive element on the side of the P-channel MOS-type FET.

Here, the gate terminal of the N-channel MOS-type FET is inputted with the abnormal-state detection signal as the output of the abnormal-state detecting unit 213. Therefore, the N-channel MOS-type FET is turned on when the level of the abnormal-state detection signal is at "1" (i.e., the normal state) and is turned off when the level of the abnormal-state detection signal is at "0" (i.e., when it has been detected that the level of the filament voltage is fixed).

On the other hand, the output signal of the inverted 130 is inputted into the gate terminal of the P-channel MOS-type FET. Therefore, the P-channel MOS-type FET is switched between on/off states in response to the level of the signal produced from the signal SX by inverting its polarity in the inverting unit 130. When the level of the abnormal-state detection signal is at "0", the P-channel MOS-type FET is turned off because "1", obtained by inverting the level of the signal SX, "0" through the inverter unit 130 is inputted into the gate terminal of the P-channel MOS-type FET.

That is, when it is detected in the abnormal-state detecting unit 213 that the filament pulse voltage is fixed, the driving signal outputting unit 140 can turn both of the P-channel MOS-type FET and the N-channel MOS-type FET off and the level of the segment driving signal can be in a high-impedance state.

In this manner, the VFD driving circuit 20 makes at least one of levels of the grid driving signal and the segment driving signal be high-impedance state as a process for abnormal-state detection when the level of the filament pulse voltage is fixed by an abnormal state of the grid voltage or the segment voltage by short-circuiting the wiring of the grid electrode 12 or the segment element 13 to the filament 11 or its wiring. Here, such a process for abnormal-state detection can be executed immediately in the VFD driving circuit 20 because no process by the external controller 40 intervenes as conventionally. That is, the VFD driving circuit 20 can execute immediately the process for abnormal-state detection, therefore, the progress of damage or ignition of the filament can be suppressed. Furthermore, the reliability of the VFD 10, especially, the reliability of the filament 11 of the VFD 10 can be improved.

The segment driver 209 (or the grid driver 210) may output the segment driving signal (or the grid driving signal) that is at the level (for example, the L level) of the side terminating the driving of the segment electrode 13 (or the grid electrode 12) when it is detected that the filament pulse voltage has been fixed. Here, in order to make the segment driving signal (or the segment driving signal) be at the L level, for example, the N-channel MOS-type FET may be set in the ON state always in the driving signal outputting unit 140.

===Control of the Output of the Filament Pulse Control Unit===

Figure 8:
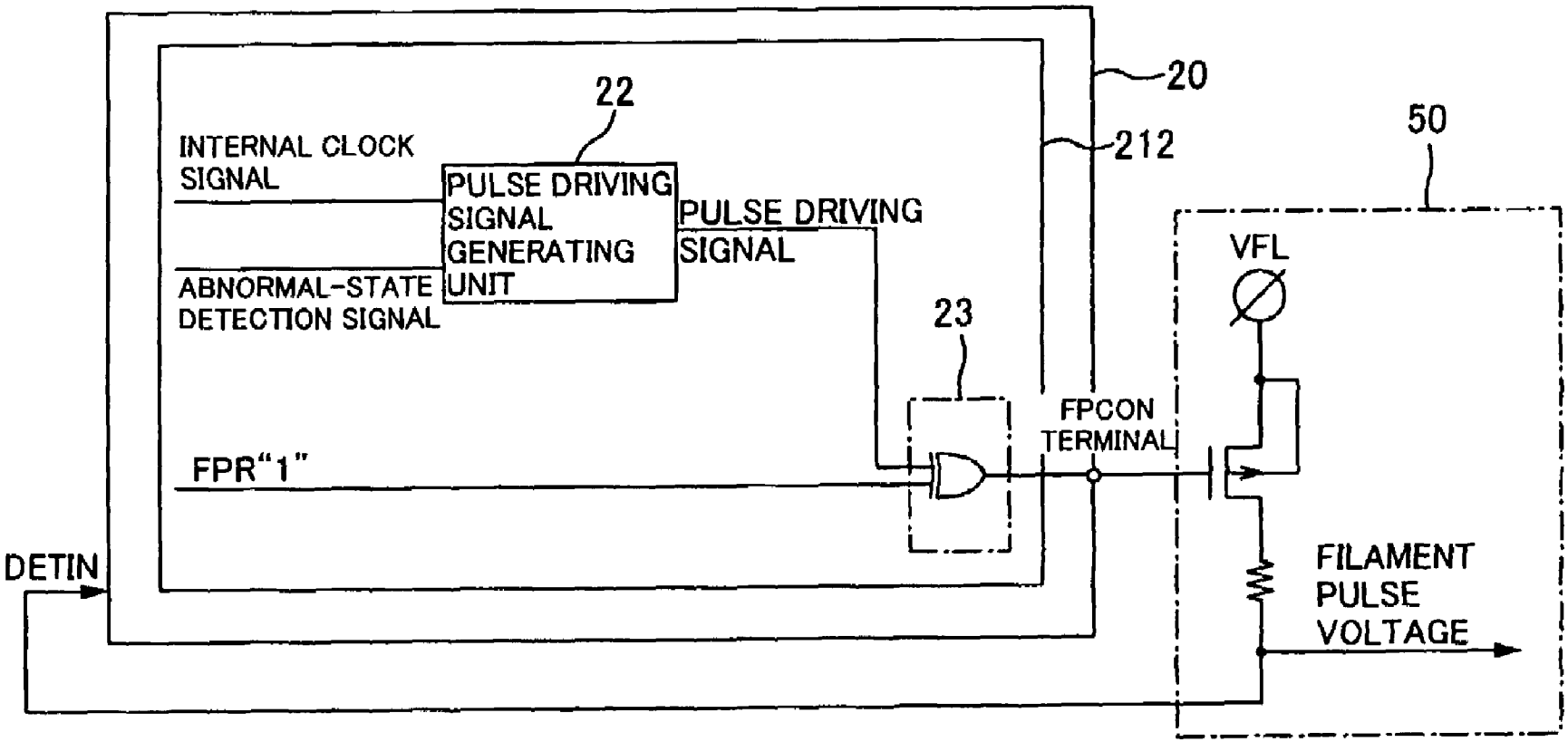
FIG. 8 shows a block diagram of a filament pulse control unit according to an embodiment of the invention.
Figure 9:
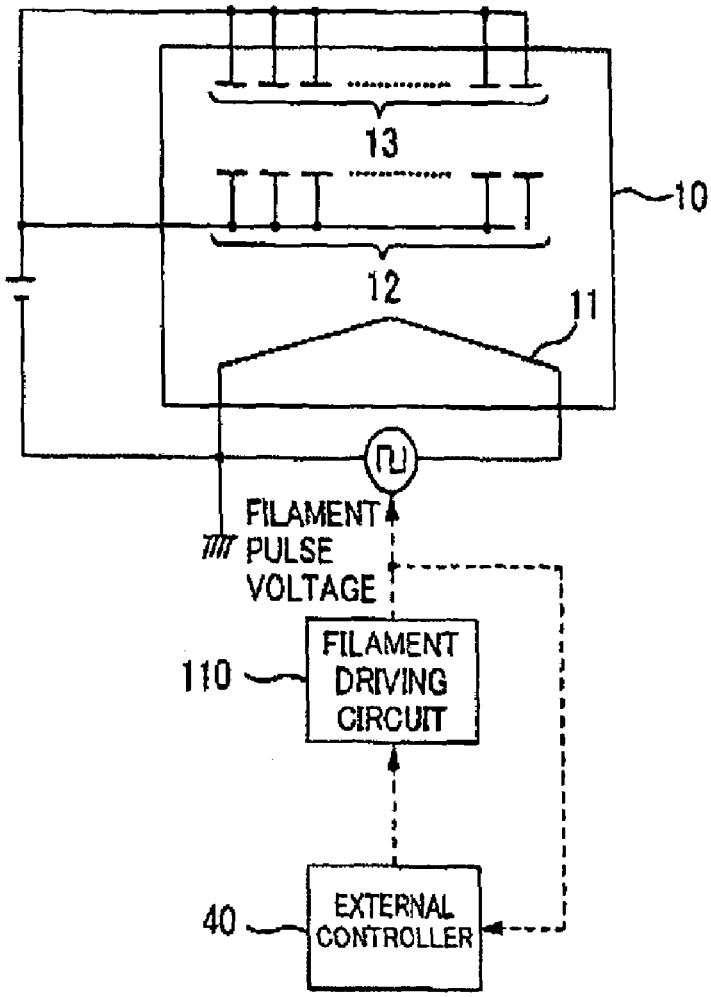
FIG. 9 illustrates a conventional mechanism for detecting an abnormal state of the filament pulse voltage.

Referring to FIG. 8, the operation of the filament pulse controlling unit 212 based on the abnormal-state detection signal (the output of the abnormal-state detection unit 213) will be described.

The filament pulse controlling unit 212 comprises a pulse driving signal generation unit 22, a pulse driving signal polarity setting unit 23 etc.

The pulse driving signal generation unit 22 forms a signal (hereinafter, referred to as "pulse driving signal") for pulse-driving the filament 11 having a predetermined duty ratio (pulse width/pulse cycle) based on an internal clock signal B supplied from a timing generation unit 204.

The pulse driving signal generation unit 22 has a composition (not shown) having, for example, a counting unit for executing counting operation for every time period of a predetermined pulse cycle based on the internal clock signal B, a comparing unit for comparing the count value as the output of the counting unit with the count value corresponding to the predetermined pulse width, and an edge forming unit for forming the edge of the pulse driving signal based on the output of the counting unit and the comparing unit.

Furthermore, the pulse driving signal generating unit 22 is inputted with the abnormal-state detection signal as the output of the abnormal-state detecting unit 213 and controls the level of the pulse driving signal such that the level is set at a level (the H level in the figure) for which the switching element 50 is turned off when the level of the abnormal-state detection signal is at "0".

The pulse driving signal polarity setting unit 23 sets the polarity of the output (the pulse driving signal) of the pulse driving signal generating unit 22 based on the level of a signal supplied from the FPR terminal. In the example shown in FIG. 8, an Ex-OR element is employed as the pulse driving signal polarity setting unit 23.

Here, the Ex-OR element outputs a pulse driving signal in response to the switching property of the switching element 50 (the P-channel MOS-type FET) by an exclusive logic sum of the output of the pulse driving signal generating unit 22 (the pulse driving signal) and the signal level "1" supplied from the FPR terminal, to the switching element 50 through the FPCON terminal. Therefore, when the level of the abnormal-state detection signal is at "0", the exclusive logic sum, "1" of the level "0" of the pulse driving signal and the signal level, "1" supplied from the FPR terminal is inputted into the gate terminal of the switching element 50 (the P-channel MOS-type FET in the figure) and the switching element 50 is set in an off state.

In this manner, the VPD driving circuit 20 terminates the pulse-driving of the filament 11 as its process for abnormal-state detection when the level of the filament pulse voltage is fixed by short-circuiting of the filament 11 or its wiring. Here, such a process for abnormal-state detection can be executed immediately in the VFD driving circuit 20 because no process by the external controller 40 intervenes as conventionally. That is, the VFD driving circuit 20 can execute immediately the process for abnormal-state detection, therefore, the progress of damage or ignition of the filament can be suppressed. Furthermore, the reliability of the VFD 10, especially, the reliability of the filament 11 of the VFD 10 can be improved. In the embodiment described above, the filament pulse controlling unit 212 may set the level of the pulse driving signal for pulse-driving the filament 11 at a high-impedance state when it is detected that the filament pulse voltage is fixed. In this case, for example, an element having a tri-state output may be connected on the output side of the pulse driving signal polarity setting unit 23 and the output of the element having the tri-state output may be set at the high-impedance state.

Furthermore, in the embodiment described above, an abnormal-state detecting flag ANF (for example, "1" for the normal state and "0" for an abnormal state) for notifying that the level of the filament pulse voltage is fixed based on the abnormal-state detection signal as the output of the abnormal-state detecting unit 213 may be outputted to the external controller 40 through the DO terminal. The VFD driving circuit 20 can improve its observability on the process for abnormal-state detection for the filament pulse voltage by outputting the abnormal detecting flag ANF to the external controller 40.

Yet furthermore, in the embodiment described above, the switching element 50 may be provided to various application circuits using the VFD driving circuit 20 (for example, a vacuum fluorescent display module). Preferably, the VFD driving circuit 20 may be a semiconductor integrated circuit and the switching element 50 may be connectable externally.

Otherwise, the circuit 20 may be a semiconductor integrated circuit embedded with the switching element 50 that is integrated.

What is claimed is:

1. A driving circuit for a vacuum fluorescent display, comprising:

a counting unit configured to count the number of fixed-width pulses per predetermined time period of a pulse voltage for pulse-driving a filament of the vacuum fluorescent display; and a detecting unit configured to output a detection signal indicating that the level of the pulse voltage is fixed, when detecting that the number of pulses per predetermined time period, counted by the counting unit, is equal to or is less than the number of a reference pulse number.

2. The driving circuit for a vacuum fluorescent display according to claim 1, wherein based on the detection signal, the driving circuit for a vacuum fluorescent display outputs, a signal for notifying that the level of the pulse voltage is fixed.

3. A driving circuit for a vacuum fluorescent display, comprising:

a counting unit configured to count a time period for which the level of a DC voltage produced by integrating a pulse voltage for pulse-driving a filament of the vacuum fluorescent display, shifts to the level indicating that the level of the pulse voltage is fixed, the pulse voltage for pulse-driving the filament comprising, in a normal state, fixed-width pulses; and a detecting unit configured to output a detection signal indicating that the level of the pulse voltage is fixed, when detecting that the time period counted by the counting unit is equal to or longer than a predetermined time period.

4. A driving circuit for a vacuum fluorescent display, comprising:

a detecting unit configured to detect that the level of a pulse voltage for pulse-driving a filament of the vacuum fluorescent display is fixed, and to output a detection signal indicative of the result of the detection, the detecting unit further comprising:

a pulse detecting unit configured to detect that the level of the pulse voltage is fixed, based on the number of pulses per predetermined time period of the pulse voltage, a level detecting unit configured to detect that the level of the pulse voltage is fixed, based on the level of a DC voltage produced by integrating the pulse voltage, and a selecting unit configured to select the output of the pulse detecting unit or the output of the level detecting unit.

5. The driving circuit for a vacuum fluorescent display according to claim 4, wherein the selecting unit selects the output of the pulse detecting unit or the output of the level detecting unit, based on data for selecting the output of the pulse detecting unit or the output of the level detecting unit.

6. The driving circuit for a vacuum fluorescent display according to claim 1, wherein the driving circuit for a vacuum fluorescent display is a semiconductor integrated circuit further comprising:

a filament pulse controlling unit configured to output a pulse-driving signal for pulse-driving the filament; and a terminal to which a switching element for generating the pulse voltage based on the pulse-driving signal, is operable to be externally connected.

7. The driving circuit for a vacuum fluorescent display according to claim 1, further comprising:

a filament pulse controlling unit configured to output a pulse-driving signal for pulse-driving the filament; and a switching element for generating the pulse voltage based on the pulse-driving signal.

8. The driving circuit for a vacuum fluorescent display according to claim 1, wherein the driving circuit for a vacuum fluorescent display is a semiconductor integrated circuit, further comprising:

a filament pulse controlling unit configured to output a pulse-driving signal for pulse-driving the filament; and a switching element for generating the pulse voltage based on the pulse-driving signal.

9. The driving circuit for a vacuum fluorescent display according to claim 3, further comprising an integrating circuit for integrating the pulse voltage so as to produce the DC voltage.

10. The driving circuit for a vacuum fluorescent display according to claim 3, wherein the driving circuit for a vacuum fluorescent display is a semiconductor integrated circuit, further comprising a terminal to which an integrating circuit for integrating the pulse voltage so as to produce the DC voltage, is operable to be connected.

11. A driving circuit for a vacuum fluorescent display, comprising:

a filament driving unit configured to pulse-drive a filament of the vacuum fluorescent display with a pulse voltage;

a grid driving unit configured to drive a grid electrode of the vacuum fluorescent display;

a segment driving unit configured to drive a segment electrode of the vacuum fluorescent display;

a detecting unit configured to output a detection signal indicating that the level of the pulse voltage is fixed, when detecting that the level of the pulse voltage is fixed, based on the number of fixed-width pulses per predetermined time period of the pulse voltage or on a DC voltage produced by integrating the pulse voltage; and a control unit configured to control the filament driving unit, the grid driving unit, and the segment driving unit, in order to terminate the driving of at least one of the filament, the grid electrode, and the segment electrode, based on the detection signal.

12. The driving circuit for a vacuum fluorescent display according to claim 11, wherein based on the detection signal, the control unit controls the filament driving unit, the grid driving unit, and the segment driving unit, such that at least one of the pulse voltage for driving the filament, the voltage for driving the grid electrode, and the voltage for driving the segment electrode, is at the level for terminating the driving of the filament, the grid electrode, and the segment electrode.

13. The driving circuit for a vacuum fluorescent display according to claim 11, wherein the control unit puts at least one output of the outputs of the filament driving unit, the grid driving unit, and the segment driving unit in a high-impedance status, based on the detection signal.

14. The driving circuit for a vacuum fluorescent display according to claim 11, wherein the driving circuit for a vacuum fluorescent display outputs a signal for notifying that the level of the pulse voltage is fixed, based on the detection signal.

15. The driving circuit for a vacuum fluorescent display according to claim 11, wherein the driving circuit for a vacuum fluorescent display is a semiconductor integrated circuit, further comprising a terminal to which a switching element for generating the pulse voltage based on the output of the filament driving unit, is operable to be connected.

16. The driving circuit for a vacuum fluorescent display according to claim 11, further comprising a switching element for generating the pulse voltage based on the output of the filament driving unit.

17. The driving circuit for a vacuum fluorescent display according to claim 3, wherein, based on the detection signal, the driving circuit for a vacuum fluorescent display outputs a signal for notifying that the level of the pulse voltage is fixed.

18. The driving circuit for a vacuum fluorescent display according to claim 3, wherein the driving circuit for a vacuum fluorescent display is a semiconductor integrated circuit, further comprising:

a filament pulse controlling unit configured to output a pulse-driving signal for pulse-driving the filament; and a terminal to which a switching element for generating the pulse voltage based on the pulse-driving signal, is operable lobe externally connected.

19. The driving circuit for a vacuum fluorescent display according to claim 3, further comprising:

a filament pulse controlling unit configured to output a pulse-driving signal for pulse-driving the filament; and a switching element for generating the pulse voltage based on the pulse-driving signal.

20. The driving circuit for a vacuum fluorescent display according to claim 3, wherein the driving circuit for a vacuum fluorescent display is a semiconductor integrated circuit, further comprising:

a filament pulse controlling unit configured to output a pulse-driving signal for pulse-driving the filament; and a switching element for generating the pulse voltage based on the pulse-driving signal.

* * * * *

UNITED STATES PATENT AND TRADEMARK OFFICE

CERTIFICATE OF CORRECTION

PATENT NO. : 7,379,036 B2
APPLICATION NO. : 10/808589
DATED : May 27, 2008
INVENTOR(S) : Hiroyuki Arai It is certified that error appears in the above-identified patent and that said Letters Patent is hereby corrected as shown below:

Column 15, line 19, “outputs,” should be changed to --outputs--.
Column 18, line 3, “lobe” should be changed to --to be--.

Signed and Sealed this

Second Day of September, 2008

JON W. DUDAS
*Director of the United States Patent and Trademark Office*